US006371218B1

(12) United States Patent
Amano et al.

(10) Patent No.: US 6,371,218 B1
(45) Date of Patent: Apr. 16, 2002

(54) IMPACT-DRIVEN ROTATING DEVICE

(75) Inventors: Masayuki Amano; Tomohiro Hosokawa; Minoru Yoshida, all of Osaka; Hidenori Shimizu, Shiga, all of (JP)

(73) Assignee: Matsushita Electric Works, Ltd., Kadomi, Osaka (JP)

( * ) Notice: Subject to any disclaimer, the term of this patent is extended or adjusted under 35 U.S.C. 154(b) by 68 days.

(21) Appl. No.: 09/590,384

(22) Filed: Jun. 9, 2000

(30) Foreign Application Priority Data

Jun. 11, 1999 (JP) ..... 11-166024

(51) Int. Cl.[7] ..... B25B 23/14

(52) U.S. Cl. ..... 173/183; 173/176; 173/180; 173/181; 73/862.23

(58) Field of Search ..... 173/6, 11, 180, 173/176, 181, 183, 177, 2; 81/429, 469, 467; 29/407, 456, 714; 73/826.21, 862.23

(56) References Cited

U.S. PATENT DOCUMENTS 4,316,512 A * 2/1982 Kibblewhite et al. ..... 173/183
4,361,945 A * 12/1982 Eshghy ..... 173/183
5,285,857 A * 2/1994 Shimada ..... 173/181
5,457,866 A 10/1995 Noda ..... 29/407
6,311,786 B1 * 11/2000 Giardino et al. ..... 73/862.23
6,161,629 A * 12/2000 Hohmann et al. ..... 173/181

FOREIGN PATENT DOCUMENTS

JP 6-304879 11/1994

* cited by examiner

*Primary Examiner*—Scott A. Smith
(74) *Attorney, Agent, or Firm*—Armstrong, Westerman & Hattori, LLP

(57) ABSTRACT

An impact-driven rotating device includes an output shaft, a hammer for rotating the output shaft by imparting an impact to the output shaft, a rotation driver for rotating the hammer, an impact detector for detecting the impact imparted by the hammer, a rotation angle detector for detecting a rotation angle of the output shaft, a rotation speed detector for detecting a rotation speed of the output shaft from the rotation angle detected by the rotation angle detector, an energy calculator for calculating energy imparted to the output shaft from the rotation speed detected by the rotation speed detector, a between-impacts rotation angle calculator for calculating a rotation angle of the output shaft rotated from when the impact detector detected the impact to when the impact detector detects an subsequent impact from the rotation angle detected by the rotation angle detector, a tightening torque calculator for calculating a tightening torque by dividing the energy calculated by the energy calculator by the rotation angle calculated by the between-impacts rotation angle calculator, and a controller for stopping the rotation driver when the tightening torque calculated by the tightening torque calculator becomes equal to or exceeds a predetermined torque.

18 Claims, 5 Drawing Sheets

IMPACT-DRIVEN ROTATING DEVICE

BACKGROUND OF THE INVENTION

1. Field of the Invention

This invention relates to an impact-driven rotating device such as an impact wrench and an impact screwdriver for tightening or loosening a bolt, a nut, a screw or the like.

2. Description of Related Art

An impact-driven rotating device is used for tightening or loosening a nut, a bolt, a screw or the like (hereinafter may simply referred to as "nut or the like"). The output shaft of the impact-driven rotating device is rotated by imparting hitting force against the output shaft using a rotatably driven hammer. This kind of impact-driven rotating device can obtain a higher tightening torque than a regular rotating device in which an output shaft thereof is directly rotated by a speed-reduction output of a motor. However, in tightening a small nut or the like, the impact-driven rotating device may cause damage thereto when too much tightening occurs. On the other hand, an operation for avoiding such damage may lead to insufficient tightening torque.

Therefore, in a conventional impact-driven rotating device, in order to control the tightening torque, the number of hitting impacts of the output shaft by a hammer is counted, and the motor is stopped when the number reaches a predetermined value by assuming that a nut or the like is tightened at a predetermined tightening torque. This utilizes the fact that tightening torque is in proportion to a square root of the number of hitting impacts.

In the aforementioned conventional impact-driven rotating device, it is assumed that no hitting impact occurs until a nut of the like comes into contact with an object. However, in a case where a coated bolt is tightened, or a member to be tightened causes a number of hitting impacts until it comes into contact with an object, it is impossible to stop the tightening operation at appropriate tightening torque.

SUMMARY OF THE INVENTION

An object of the present invention is to provide an impact-driven rotating device which is capable of tightening a member at predetermined tightening torque.

According to a first aspect of the present invention, an impact-driven rotating device includes an output shaft, a hammer for rotating the output shaft by imparting impact to the output shaft, and a rotation driver for rotating the hammer. The impact-driven rotating device further includes an impact detector, a rotation angle detector, a rotation speed detector, an energy calculator, a between-impacts rotation angle calculator, a tightening torque calculator, and a controller. The impact detector detects the impact imparted by the hammer. The rotation angle detector detects a rotation angle of the output shaft. The rotation speed detector detects a rotation speed of the output shaft from the rotation angle detected by the rotation angle detector. The energy calculator calculates energy imparted to the output shaft from the rotation speed detected by the rotation speed detector. The between-impacts rotation angle calculator calculates a rotation angle of the output shaft rotated within a time interval from a detection of a previous impact to that of a subsequent impact by the impact detector from the rotation angle detected by the rotation angle detector. The tightening torque calculator calculates tightening torque by dividing the energy calculated by the energy calculator by the rotation angle calculated by the between-impacts rotation angle calculator. The controller stops the rotation driver when the tightening torque calculated by the tightening torque calculator becomes equal to, or greater than, a predetermined value.

The energy imparted to the output shaft by hitting the shaft by a hammer is generally equal to the energy to be consumed for tightening a member. Therefore, in the aforementioned impact-driven rotating device, the energy calculator calculates the energy imparted to the output shaft from the rotation speed detected by the rotation speed detector, and the tightening torque calculator calculates the tightening torque by dividing the energy calculated by the energy calculator by the rotation angle calculated by the between-impacts rotation angle calculator. Accordingly, the accuracy of detecting the tightening torque can be enhanced, resulting in an appropriate tightening operation with predetermined tightening torque.

In the aforementioned impact-driven rotating device according to the first aspect of the present invention, it is preferable that the rotation driver includes a driver main body having a drive shaft and a reducer for transmitting a rotation of the drive shaft to the hammer at a predetermined reduction ratio, wherein the rotation angle detector includes a drive shaft rotation angle detector for detecting a rotation angle of the drive shaft to detect the rotation angle of the output shaft from the detected value detected by the drive shaft rotation angle detector, and wherein the between-impacts rotation angle calculator calculates a rotation angle of the driving shaft rotated within a time interval from a detection of a previous impact to that of a subsequent impact by the impact detector from the detected value detected by the driving shaft rotation angle detector, and calculates the rotation angle of the output shaft by subtracting the rotational angle difference between the rotation angle of the hammer and that of the output shaft generated each impact of the output shaft from the value obtained by dividing the rotation angle detected by the driving shaft rotation angle detector by the reduction ratio of the reducer.

With this impact-driven rotating device, there is no need to attach the rotation angle detector to the output shaft in order to detect the rotation angle of the output shaft which is easily affected by oil, dust or the like, resulting in enhanced reliability of the calculated tightening torque.

In the aforementioned impact-driven rotating device according to the first aspect of the present invention, it is preferable that the impact-driven rotating device further includes an impact number counter, wherein the impact number counter counts the number of impacts caused by hitting the output shaft by the hammer after the rotation angle calculated by the between-impacts rotation angle calculator becomes smaller than a predetermined threshold value, and wherein the tightening torque calculator calculates a tightening torque by multiplying a square root of the number of impacts counted by the impact number counter by a proportional coefficient determined in accordance with a member to be tightened.

When the rotation angle calculated by the between-impacts rotation angle calculator becomes smaller than a predetermined threshold value, it becomes impossible to neglect an error of the detected rotation angle or an error resulting from the division of the energy by the detected rotation angle. However, in the impact-driven rotating device, since the tightening torque calculator calculates tightening torque by multiplying a square root of the number of impacts counted by the impact number counter by a proportional coefficient, an error of the detected rotation angle in a high-torque region where the rotation angle of the output shaft is small or an effect of an error resulting from the division of the energy by the rotation angle can be avoided. This enhances the accuracy of detecting a tightening torque.

In a case where the energy imparted to the output shaft every impacts is constant, the rotation speed calculator can be omitted. Therefore, according to the second aspect of the present invention, an impact-driven rotating device includes an output shaft, a hammer for rotating the output shaft by imparting impact to the output shaft, a rotation driver for rotating the hammer, an impact detector for detecting the impact imparted by the hammer, a rotation angle detector for detecting a rotation angle of the output shaft, a between-impacts rotation angle calculator for calculating a rotation angle of the output shaft rotated between a detection of a previous impact and that of a subsequent impact by the impact detector from the rotation angle detected by the rotation angle detector, a tightening torque calculator for calculating tightening torque by dividing the energy calculated by the energy calculator by the rotation angle calculated by the between-impacts rotation angle calculator, and a controller for stopping the rotation driver when the tightening torque calculated by the tightening torque calculator becomes equal to, or greater than, a predetermined value.

Other objects and advantages of the present invention will become apparent from the description of the preferred embodiments, which may be modified in any manner without departing from the scope and spirit of the present invention.

DETAILED DESCRIPTION OF THE PREFERRED EMBODIMENTS

Preferred embodiments of an impact-driven rotating device according to the present invention will now be described in detail with reference to the accompanying drawings.

(First Embodiment)

Figure 1:
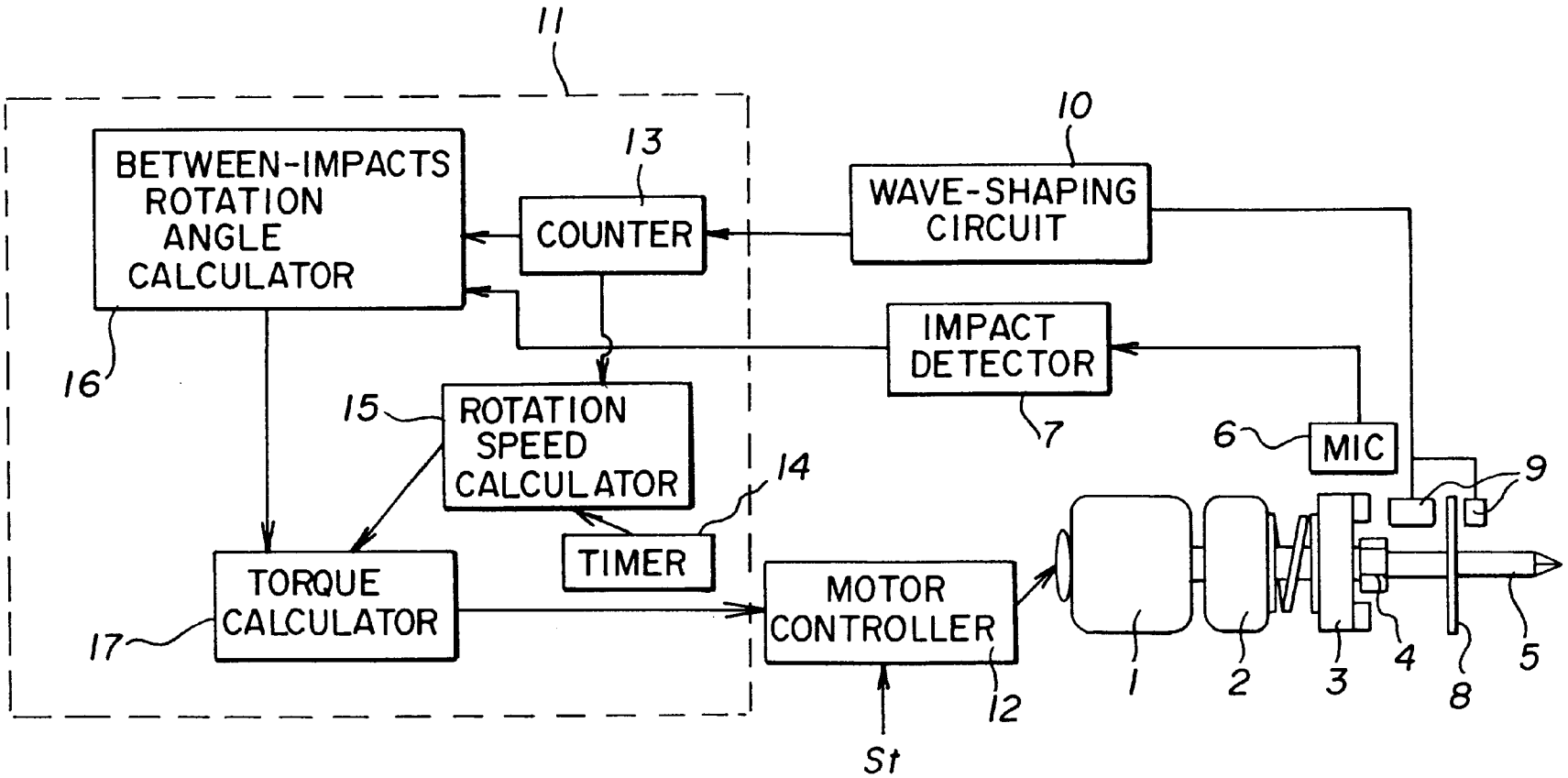
FIG. 1 is a schematic structural view of an impact-driven rotating device according to a first embodiment of the present invention.

FIG. 1 shows a schematic structural view of the impact-driven rotating device according to the present invention.

The impact-driven rotating device includes a motor 1 as a driving means, a reducer 2, a hammer 3, an output shaft 5, a microphone 6, an impact detector 7, a light-shield plate 8, photo-interrupters 9, a wave-shaping circuit 10, a controlling circuit 11 and a motor controller 12. The motor 1 and the reducer 2 constitute a rotation driver.

The reducer 2 reduces the rotation of a driving shaft of the motor 1 at a predetermined reduction ratio. A rotational force of the motor 1 is transmitted to the hammer 3 via the reducer 2. The output shaft 5 is equipped with an anvil portion 4 to be imparted by the hammer 3 to create an impact-driven rotating force. The microphone 6 converts the impacting sound caused by the hammer 3 into an electrical signal. The impact detector 7 detects an impacting force on the anvil portion 4 caused by the hammer 3 when an output voltage of the microphone 6 exceeds a predetermined threshold value. The light-shield plate 8 is a generally round plate having a plurality of slits (not shown) formed therein, and is attached to the output shaft 5. The photo-interrupters 9 are disposed at opposite sides of a portion of the light-shield plate 8 where the slits are formed. The wave-shaping circuit 10 wave-shapes the signals outputted from the photo-interrupters 9 in accordance with a rotation of the light-shield plate 8 to generate pulse signals. The number of pulse signals corresponds to the rotation angle of the output shaft 5. The controlling circuit 11 calculates a tightening torque from an output of the impact detector 7 and an output of the wave-shaping circuit 10 to generate a stop signal for stopping the motor 1 when a tightening torque becomes equal to, or greater than, a predetermined value. The motor controller 12 starts the motor 1 in accordance with a trigger signal (speed instruction) inputted by an operation of an operation portion (not shown), and stops the rotation of the driving shaft of the motor 1 depending on a stop signal inputted from the controlling circuit 11.

The controlling circuit 11 includes a counter 13 as a rotation angle detector, a timer 14, a rotation speed calculator 15, a between-impacts rotation angle calculator 16, and a tightening torque calculator 17.

The counter 13 counts the number of pulse signals inputted from the wave-shaping circuit 10. The timer 14 generates an interrupt signal at certain time intervals. The rotation speed calculator 15 calculates the rotation speed of the output shaft 5 from a value of the counter 13 counted between inputs of a previous interrupt signal and a subsequent interrupt signal. The between-impacts rotation angle calculator 16 calculates a rotation angle of the output shaft 5 from the values of the counter 13 counted within a time interval from a detection of a previous impact to that of a subsequent impact. The tightening torque calculator 17 calculates energy imparted to the output shaft 5 from the rotation speed of the output shaft 5 calculated by the rotation speed calculator 15 when the output shaft 5 is imparted by the hammer 3, and calculates a tightening torque from the energy calculated by the tightening torque calculator 17 and the rotation angle calculated by the between-impacts rotation angle calculator 16 to generate a stop signal for stopping the motor 1 when the tightening torque becomes equal to, or greater than, predetermined torque. The controlling circuit 11 may be constituted by, for example, a one-tip microcomputer.

Figure 3:
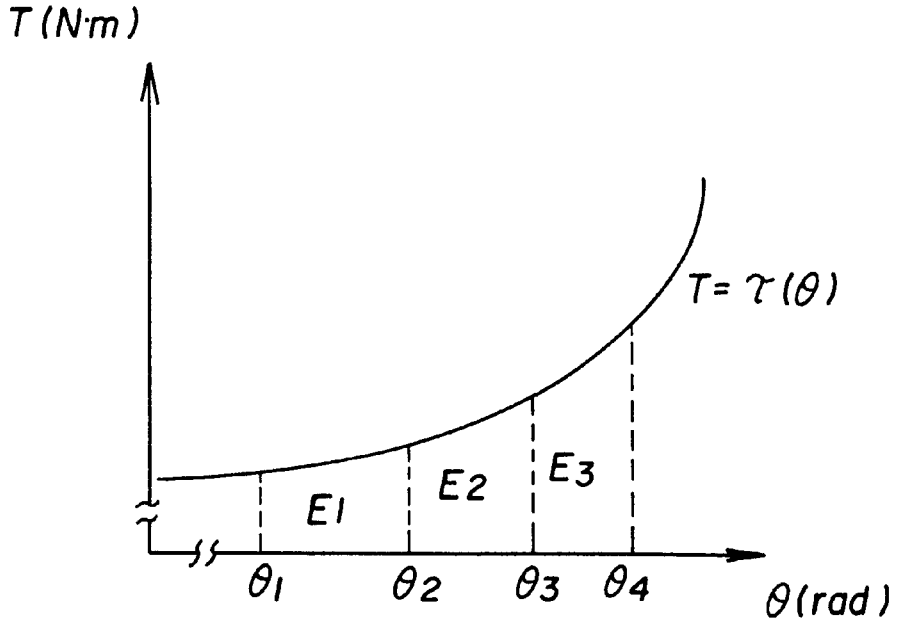
FIG. 3 is a graph showing the relationship between the rotation angle of the output shaft and the tightening torque.

In the meantime, in the impact-driven rotating device according to this embodiment, since the energy imparted to the output shaft 5 by hitting the anvil portion 4 by the hammer 3 is generally the same as the energy to be consumed when a nut or the like is tightened, tightening torque is calculated. Although the relationship between the rotation angle $\theta$ of the output shaft 5 rotated after the nut or the like contacts an object and the tightening torque T [N·m] may differ depending on the member to be tightened, the relationship between the rotation angle $\theta$ and the tightening torque T can be represented by a function $T=\tau(\theta)$ as shown in FIG. 3. In FIG. 3, the impacts of the anvil portion 4 caused by the hammer 3 were generated at the rotation angles $\theta 1$, $\theta 2$, $\theta 3$ and so on.

The value E1 obtained by integrating the function $\tau$ by the section ($\theta 1$, $\theta 2$) corresponds to the energy consumed for tightening operation, and becomes equal to the energy imparted to the output shaft 5 hit by the hammer 3 when the rotation angle θ is θ1. Therefore, the average torque Ta at the section (θ1, θ2) is represented by Ta=E1/(θ1, θ2). In other words, the average torque Ta at a section (θn, θ(n+1)) (n=1, 2, 3 . . . ) is represented by Ta=En/(θ(n+1)−θn), wherein the value obtained by integrating the function τ by the section (θn, θ(n+1)) is represented by En. Accordingly, desired tightening torque can be obtained by controlling the motor controller 12 by the controlling circuit 11 so as to stop the motor 1 when the average torque Ta becomes equal to, or greater than, a predetermined torque.

Figure 2:
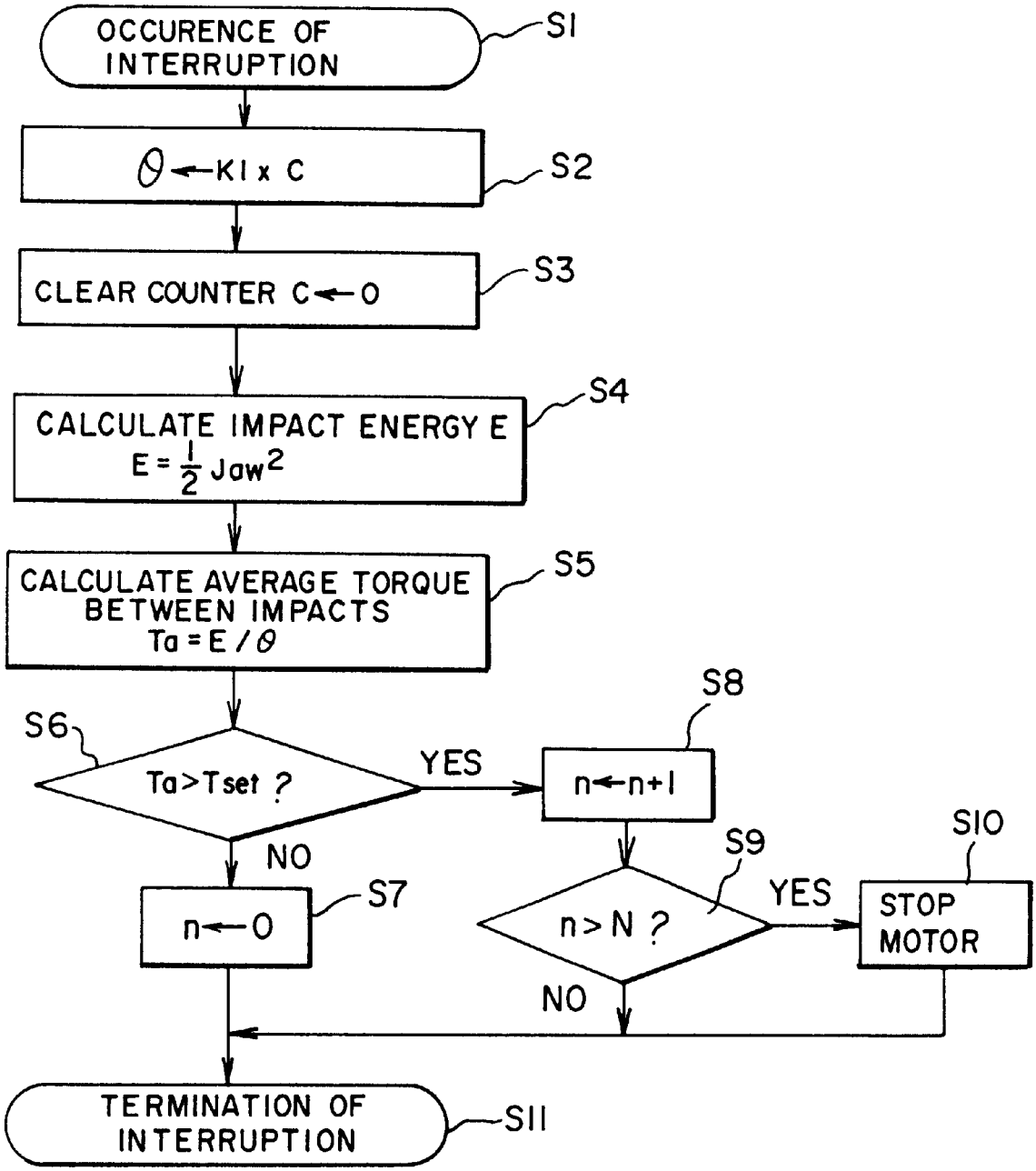
FIG. 2 is a flowchart showing the operation of the impact-driven rotating device shown in FIG. 1.

The operation of each portion will be explained with reference to the flowchart shown in FIG. 2.

The impact detector 7 detects the impact of the anvil portion 4 caused by the hammer 3 when the output voltage of the microphone 6 exceeds a predetermined threshold value. The impact detector 7 outputs an interrupt signal to the between-impacts rotation angle calculator 16 when the impact detector 7 detects the impact (step S1).

When the anvil portion 4 is hit by the hammer 3 to cause a rotation of the output shaft 3, the light-shield plate 8 rotates together with the output shaft 5, and the output of the photo-interrupters changes depending on the rotation of the output shaft 5. The wave-shaping circuit 10 wave-shapes the output of the photo-interrupter 9 to generate a wave-shaped pulse signal, and the counter 13 counts the number of the pulse signals.

When an interrupt signal is inputted into the between-impacts rotation angle calculator 16 from the impact detector 7, the between-impacts rotation angle calculator 16 reads the counted value C of the counter 13, and multiplies the counted value C by a coefficient K1 to calculate a rotation angle θ (=K1×C) of the output shaft 5 rotated during the time from when the impact detector 7 detects a previous impact to now (step 2). After the calculation of the rotation angle θ, the between-impacts rotation angle calculator 16 clears the counted value C of the counter 13. The coefficient K1 is a value obtained by dividing 2n by the number of pulse Np outputted from the wave-shaping circuit 10 every rotations of the output shaft 5 (K1=2π/Np), i.e., the rotation angle [rad] of the output shaft 5 per pulse.

The timer 14 outputs an interrupt signal into the rotation speed calculator 15 at constant time intervals. When the interrupt signal is inputted into the rotation speed calculator 15 from the timer 14, the rotation speed calculator 15 reads the counted value C of the counter 13, calculates the number of pulse generated at a certain time period from the difference between the previous counted value C and the current counted value C at the time the previous interruption signal is inputted, and then calculates a rotation speed ω of the output shaft 5 by dividing the rotation angle of the output shaft 5 corresponding the number of pulse by the certain time.

The torque calculator 17 as an energy calculating means calculates the energy E imparted to the output shaft 5 from the rotation speed ω of the output shaft 5 just after the impact calculated by the rotation speed calculator 15 by utilizing the equation (1) (step S4). In the equation (1), Ja denotes a rotational moment of the output shaft 5.

$$E=(1/2)\times Ja\times\omega^2 \quad (1)$$

The torque calculator 17 calculates average torque Ta between impacts of the output shaft 5 by dividing the energy E obtained from the equation (1) by the rotation angle θ calculated by the between-impacts rotation angle calculator 16 (step S5). It is judged whether the calculated average torque Ta is larger than the set value Tset (step S6). If the average torque Ta is equal to, or smaller than, the set value Tset, it is judged by the tightening torque calculator 17 that the nut or the like does not reach an object. Then, the counted value n is reset (step 7) and the interruption process terminates (step S11).

On the other hand, when the average torque Ta exceeds the set value Tset, it is judged by the torque calculator 17 that the nut or the like touches an object. Then, 1 is added to the counted value n (step S8), and it is judged whether the counted value n exceeds the set value N (step S9). When the counted value n is equal to, or smaller than, the set value N, it is judged by the torque calculator 17 that the tightening torque does not reach the predetermined value, and then the interrupt processing terminates (step S11). On the other hand, when the counted value n exceeds the set value N, i.e., the average torque Ta exceeds the set value Tset consecutively 7 times, it is judged by the torque calculator 17 as a control means that the tightening torque exceeds the predetermined value, and the torque calculator 17 outputs a stop signal to the motor controller 12 to stop the motor 1 (step S10). Then, the interrupt process terminates (step S11).

As mentioned above, the torque calculator 17 calculates the energy E imparted to the output shaft 5 when the hammer 5 hits the output shaft 5 from the rotation speed calculated by the rotation speed calculator 15. The calculated energy E is generally equal to the energy consumed for tightening a nut or the like. Therefore, the tightening torque is calculated by dividing the calculated energy E by the rotation angle θ calculated by the between-impacts rotation angle calculator 16. Therefore, even in a case where a member to be tightened generates impacts before reaching the object, the tightening torque can be detected with high accuracy, resulting in a tightening operation with predetermined tightening torque. Furthermore, by appropriately setting the tightening torque, it is possible to stop the tightening operation of the nut or the like when it reaches the object.

In the case where it is possible to assume that the energy to be imparted to the output shaft 5 every impacts is generally constant, the torque calculator 17 may output a stop signal to the motor controller 12 to stop the motor 1 when the rotation angle θ of the output shaft 5 calculated by the between-impacts rotation angle calculator 16 becomes equal to, or smaller than, a certain set value, i.e., when the result obtained by dividing the energy by the rotation angle θ (tightening torque) becomes equal to, or greater than, predetermined torque. In this case, the rotation speed calculator 15 can be omitted.

(Second Embodiment)

Figure 4:
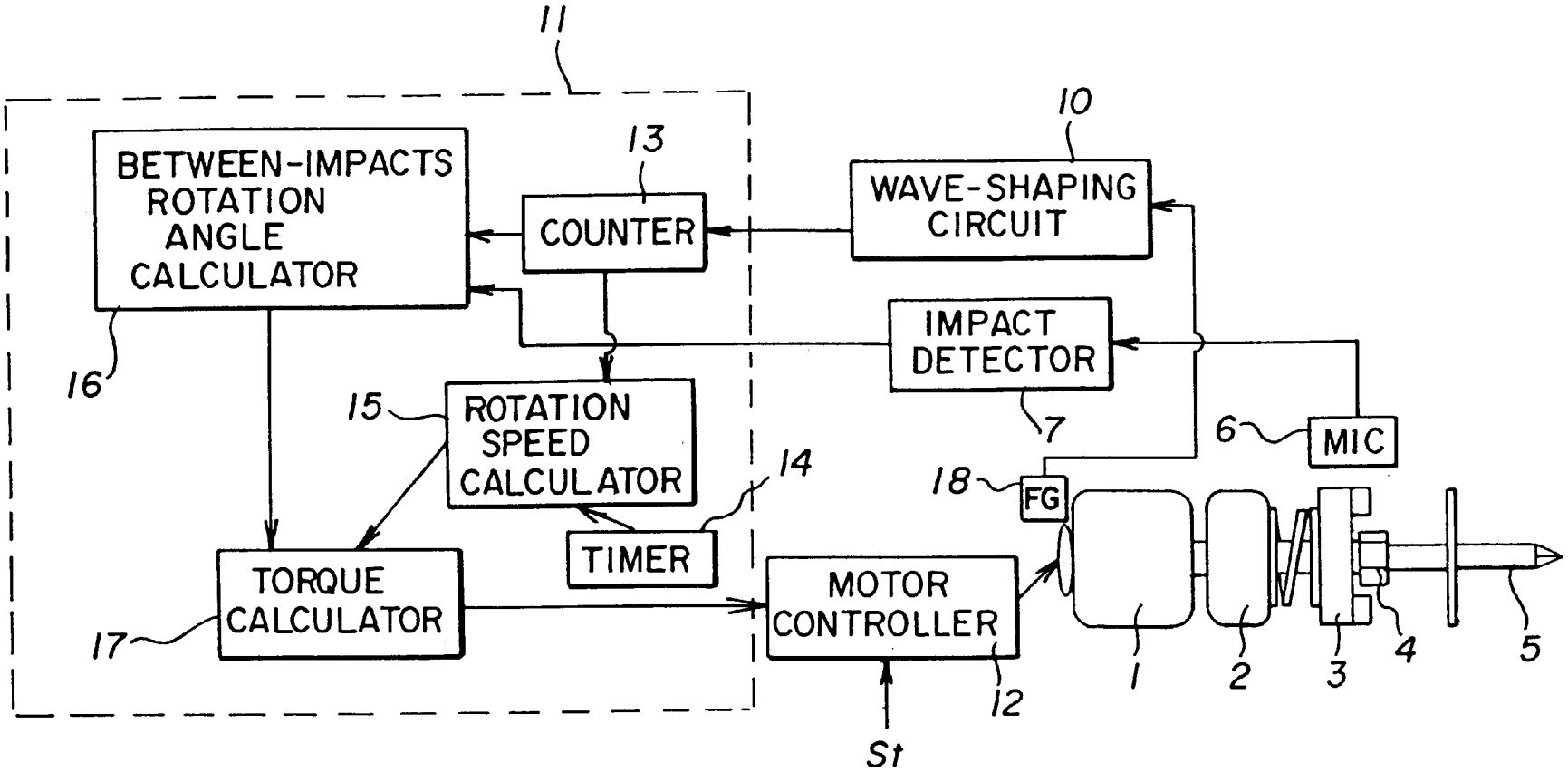
FIG. 4 is a schematic structural view of an impact-driven rotating device according to a second embodiment of the present invention.

FIG. 4 shows a schematic structural view of an impact-driven rotating device according to the second embodiment of the present invention.

In this embodiment, in place of the light-shield plate 8 and the photo-interrupters 9 in the first embodiment, a frequency generator (FG) 18 is provided as a driving shaft rotation angle detecting means. The frequency generator 18 is attached to the motor 1 to generate a signal of a frequency proportional to the rotational speed of the motor 1. The wave-shaping circuit 10 wave-shapes the signal generated by the frequency generator 18 to output pulse signals. The number of the pulse signals corresponds to the rotation angle of the output shaft 5. The counter 13 counts the number of pulse signals inputted from the wave-shaping circuit 10. Since the structure other than the frequency generator 18 is the same as in the first embodiment, the explanation will be omitted by allotting the same reference numerals to the corresponding structural elements.

Figure 5:
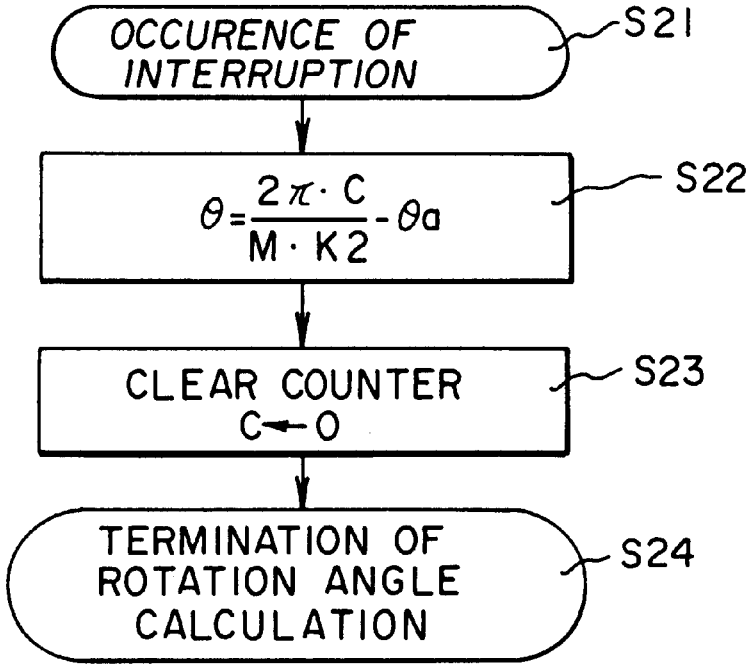
FIG. 5 is a flowchart showing the operation of the impact-driven rotating device shown in FIG. 4.

As mentioned above, in the impact-driven rotating device according to the first embodiment, the rotation angle of the output shaft 5 is directly detected. To the contrary, in the impact-driven rotating device according to this second embodiment, the rotation angle of the output shaft 5 is calculated from the rotation angle of the driving shaft of the motor 1. The process for calculating the rotation angle of the output shaft 5 by the rotation speed calculator 15 will be explained with reference to the flowchart shown in FIG. 5.

The impact detector 7 detects the occurrence of the output shaft 5 being imparted from the output voltage of the microphone 6, and outputs an interrupt signal to the between-impacts rotation angle calculator 16 (step S21). Then, the between-impacts rotation angle calculator 16 reads the counted value C of the counter 13, and calculates the rotation angle θ by which the output shaft 5 rotates between the detection of the previous impact and the subsequent impact by the impact detector 7 by utilizing the equations (2) and (3) (step S22).

$$\phi=2\pi C/M \tag{2}$$

$$\theta=\phi/K2-\theta a=2\pi C/(M\cdot K2)-\theta a \tag{3}$$

In the above equations, ϕ denotes a rotation angle of the driving shaft of the motor 1 rotated between the previous detection of the impact and the subsequent detection of the impact by the impact detector; M denotes the number of pulses outputted from the wave-shaping circuit 10 every rotations of the driving shaft of the motor 1; K2 denotes a reduction ratio of the reducer 3; θa denotes a difference of the rotation angle between the rotation angles of the hammer 3 and the output shaft 5 generated every impacts of the anvil portion 4 by the hammer 4.

After the calculation of the rotation angle θ of the output shaft 5 by the between-impact rotation angle calculator 16, the calculator 16 clears the counted value C of the counter 13 (step S23), and terminates the calculation processing of the rotation angle θ (Step S24). Since the processing after the calculation of the rotation angle θ of the output shaft 5 is the same as in the processing of steps S4 to S11 in the first embodiment, the explanation will be omitted.

In the impact-driven rotating device according to this embodiment, the rotation angle of the output shaft 5 is calculated from the output of the frequency generator 18 provided to the motor 1. Therefore, it is not required to provide a sensor for detecting the rotation angle of the output shaft 5 at a portion near the output shaft 5 which is easily be affected by oil or dust. This enhances the liability of the calculated tightening torque.

(Third Embodiment)

As mentioned above, in the first embodiment of the present invention, the rotation speed calculator 15 calculates the rotation speed ω of the output shaft 5 just after the impact, the between-impacts rotation angle calculator 16 calculates the rotation angle θ by which the output shaft 5 rotates between the previous impact and the subsequent impact, the torque calculator 17 calculates the energy E imparted to the output shaft 5 from the rotation speed ω of the output shaft 5, and the average torque Ta is calculated by dividing the calculated energy E by the rotation angle θ. However, in a high-torque region where the rotation angle θ of the output shaft 5 is very small, a possible detection error of the rotation angle θ and/or the calculation error, which can occur when dividing the energy E by the rotation angle θ, cannot be neglected.

Therefore, in the impact-driven rotating device according to this third embodiment, in a region where the rotation angle θ calculated by the between-impacts rotation angle calculator 16 is large enough, i.e., in a region where the detection error of the rotation angle θ itself or an error resulting from the division of the energy E by the rotation angle θ can be neglected, the torque calculator 17 calculates the average torque Ta in the same manner as in the first embodiment. On the other hand, in a region where the rotation angle θ becomes smaller than the predetermined threshold value, i.e., in a region where the detection error of the rotation angle θ itself or an error resulting from the division of the energy E by the rotation angle θ cannot be neglected, the average torque Ta is calculated by multiplying a square root of the number of the impacts of the output shaft 5 by a proportional coefficient K3 which is determined by a member to be tightened. Since the structure of the impact-driven rotating device of this embodiment is similar to that of the impact-driven rotating device of the first embodiment, the explanation will be omitted.

Figure 6:
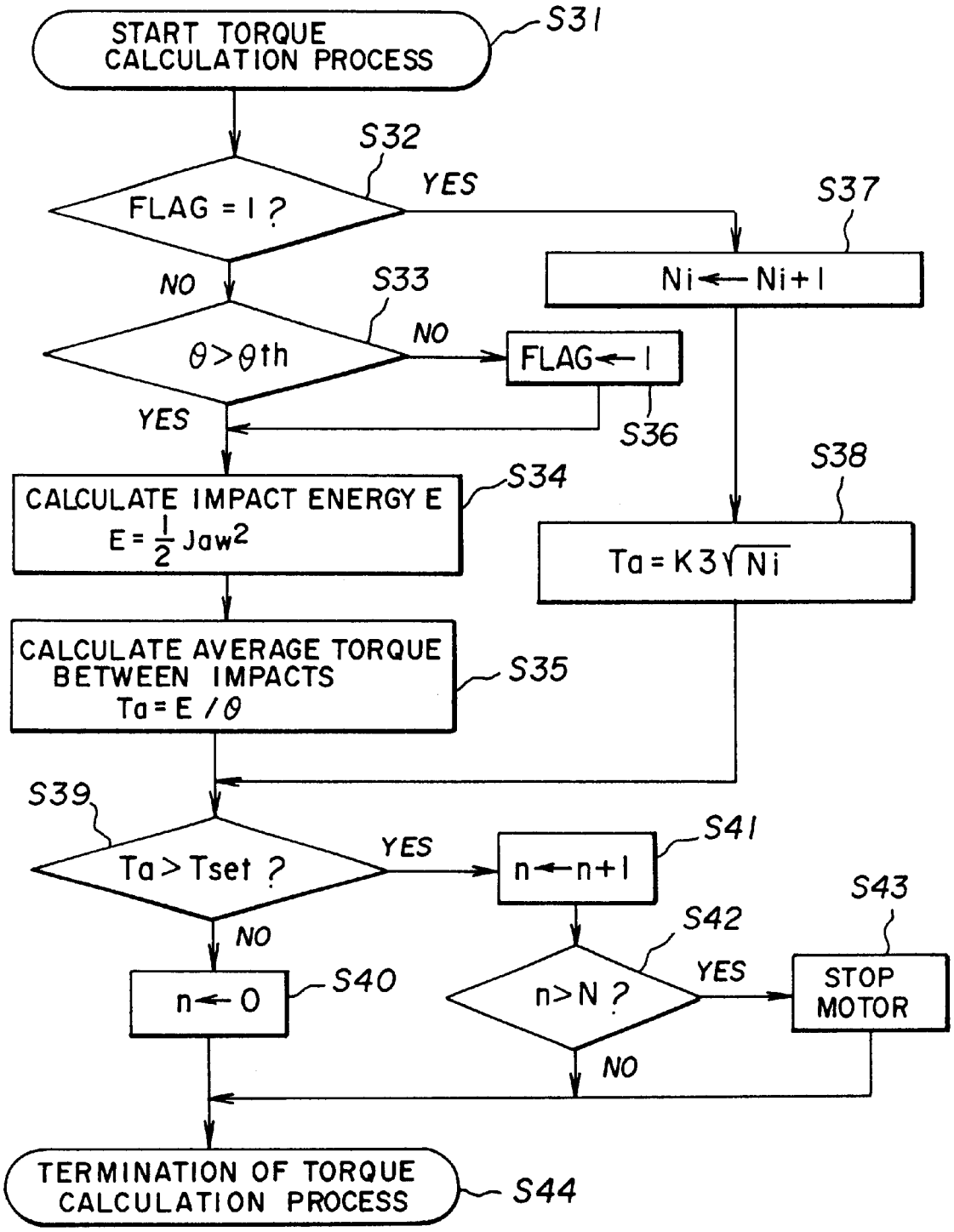
FIG. 6 is a flowchart showing the operation of the impact-driven rotating device according to a third embodiment of the present invention.

The process for calculating the torque by the torque calculator 17 will be explained with reference to the flowchart shown in FIG. 6, in which the values of the flag (flag) and the variable Ni are both initialized to zero (0).

As explained in the first embodiment, when the impact detector 7 detects the occurrence that the output shaft 5 is imparted by the hammer 3, the impact detector 7 outputs an interrupt signal to the between-impacts rotation angle calculator 16. When the interrupt signal is inputted into the between-impacts rotation angle calculator 16 from the impact detector 7, the calculator 16 calculates the rotation angle θ of the output shaft 5 rotated between the previous impact and now. Then, the torque-calculator 17 starts the torque calculation process of torque (step S31)

It is judged by the torque calculator 17 whether the value of the flag (flag) is 1 (step S32) At the time when the program starts, the value of flag (flag) is initialized to zero (0). If the value of the flag (flag) is zero (0), it is judged by the torque calculator 17 whether the rotation angle θ calculated by the between-impacts rotation angle calculator 16 is larger than the predetermined threshold θth (step S33).

If the rotation angle θ is larger than the threshold value θth, the torque calculator 17 calculates the energy E, which is imparted to the output shaft 5 from the rotation speed ωof the output shaft 5 just after the impact calculated by the rotation speed calculator 15, by utilizing the aforementioned equation (1) (step S34). Then, the torque calculator 17 calculates the average torque Ta (=E/θ) by dividing the energy E calculated by utilizing the equation (1) by the rotation angle θ calculated by the between-impacts rotation angle calculator 16 (step S35). On the other hand, when the rotation angle θ becomes smaller than the threshold value θth, the torque calculator 17 sets the value of flag (flag) to 1 (step S36), and then calculates the average torque Ta by executing the steps S34, S35.

In the meantime, when the rotation angle θ calculated by the between-impacts rotation angle calculator 16 becomes equal to, or smaller than, the threshold value θth, the torque calculator 17 sets the value of flag (flag) to 1. Therefore, when the output shaft 5 is imparted by the hammer 3 next and the impact detector 7 outputs an interrupt signal to the between-impacts rotation angle calculator 16, the between-impacts rotation angle calculator 16 calculates the rotation angle θ of the output shaft 5 rotated between the previous impact and now, and the torque calculator 17 starts the torque calculation process (step S31). At this time, it is judged by the torque calculator 17 whether the value of flag lot (flag) is 1 (step S32). When the value of the flag (flag) is 1, 1 is added to the variable Ni (step S37). Then, the torque calculator 17 calculates the average torque Ta by utilizing the equation (4) (step S38).

$$Ta=K3\cdot(Ni)^{1/2} \quad (4)$$

Next, it is judged by the torque calculator 17 whether the calculated torque Ta is larger than the set value Tset (step S39). When the average torque Ta is equal to, or smaller than, the set value Tset, it is judged by the torque calculator 17 that the nut of the like does not reach the object, and sets the counted value n to zero (0) (step S40). Then, the torque calculation process terminates (Step S44). On the other hand, when the average torque Ta is equal to, or greater than, the set value Tset, it is judged by the torque calculator 17 that the nut of the like reaches the object, and add 1 to the counted value n (step S41). Then, it is judged by the torque calculator 17 whether the counted value n is larger than the set value N(step S42). When the counted value n is equal to, or smaller than, the set value N, it is judged by the torque calculator 17 that the tightening torque does not reach the predetermined value, and terminates the torque calculation processing (Step S44). On the other hand, when the counted value n exceeds the set value N, i.e., when the average torque Ta exceeds the set value Tset consecutively N times, it is judged by the torque calculator 17 that the tightening torque reaches the predetermined value, and outputs a stop signal to stop the motor 1 (step S43). Then, the torque calculation processing terminates (Step S44).

As mentioned above, in this embodiment, at the initializing stage, since the value of flag (flag) is set to zero (0), the torque calculator 17 calculates the average torque Ta in the same manner as in the first embodiment. Thereafter, in a case where the rotation angle θ becomes equal to, or smaller than, the threshold value θth, i.e., a detection error of the rotation angle θ or an error resulting from the division of the energy E by the rotation angle θ cannot be neglected, the tightening torque Ta is calculated by multiplying the square root of the number (i.e., variable number Ni) of impacts of the output shaft 5 caused by the hammer 3 by a proportional coefficient K3 which is determined by a member to be tightened after the rotation angle θ becomes equal to, or smaller than, the threshold value th. Therefore, it is possible to reduce a detection error of the rotation angle θ or an error resulting from the division of the energy E by the rotation angle θ at a high-torque region. In other words, the torque calculator 17 changes the calculation method for calculating the tightening torque between a low-torque region and a high-torque region. In each region, the tightening torque can be calculated with high efficiency.

When the calculated average torque Ta exceeds the set value Tset consecutively N times, it is judged that the tightening torque exceeds the predetermined value. Then, the torque calculator 17 outputs a stop signal to the motor controller 12 to stop the motor 1. Therefore, the tightening torque can be controlled with high accuracy.

According to a first aspect of the present invention, since the energy imparted to the output shaft by hitting the shaft by a hammer is equal to the energy to be consumed for tightening a member to be tightened, the energy calculator calculates the energy imparted to the output shaft from the rotation speed detected by the rotation speed detector, and the tightening torque calculator calculates the tightening torque by dividing the energy calculated by the energy calculator by the rotation angle calculated by the between-impacts rotation angle calculator. Accordingly, the accuracy of detecting the tightening torque can be enhanced, resulting in an appropriate tightening operation with predetermined tightening torque.

In a case where the energy imparted to the output shaft every impacts is constant, the rotation speed calculator can be omitted. Therefore, according to the second aspect of the present invention, an impact-driven rotating device includes an output shaft, a hammer for rotating the output shaft by imparting impact to the output shaft, a rotation driver for rotating the hammer, an impact detector for detecting the impact imparted by the hammer, a rotation angle detector for detecting a rotation angle of the output shaft, a between-impacts rotation angle calculator for calculating a rotation angle of the output shaft rotated between a detection of a previous impact and that of a subsequent impact by the impact detector, from the rotation angle detected by the rotation angle detector, a tightening torque calculator for calculating a tightening torque by dividing the energy calculated by the energy calculator by the rotation angle calculated by the between-impacts rotation angle calculator, and a controller for stopping the rotation driver when the tightening torque calculated by the tightening torque calculator becomes equal to or greater than a predetermined value.

The terms and expressions which have been employed herein are used as terms of description and not of limitation, and there is no intent, in the use of such terms and expressions, of excluding any equivalents of the features shown and described or portions thereof, but it should be recognized that various modifications are possible within the scope of the invention claimed.

This application claims priority of Japanese Patent Application No. Hei 11-166024 filed on Jun. 11, 1999, the disclosure of which is incorporated by reference in its entirety.

What is claimed is:

1. An impact-driven rotating device, comprising:

an output shaft;

a hammer for rotating said output shaft by imparting impact to said output shaft;

a rotation driver for rotating said hammer;

an impact detector for detecting the impact imparted by said hammer;

a rotation angle detector for detecting a rotation angle of said output shaft;

a rotation speed detector for detecting a rotation speed of said output shaft from the rotation angle detected by said rotation angle detector;

an energy calculator for calculating energy imparted to said output shaft, from the rotation speed detected by said rotation speed detector;

a between-impacts rotation angle calculator for calculating a rotation angle of said output shaft rotated between a detection of a previous impact and that of a subsequent impact by said impact detector, from the rotation angle detected by said rotation angle detector;

a tightening torque calculator for calculating a tightening torque by dividing the energy calculated by said energy calculator by the rotation angle calculated by said between-impacts rotation angle calculator; and a controller for stopping said rotation driver when the tightening torque calculated by said tightening torque calculator becomes equal to or greater than a predetermined value.

2. The impact-driven rotating device as recited in claim 1, wherein said output shaft is provided with an anvil portion to be hit by said hammer to cause an impact rotation force to said output shaft.

3. The impact-driven rotating device as recited in claim 1, wherein said rotation driver includes a motor having a drive shaft and a reducer for transmitting a rotation of said drive shaft to said hammer at a predetermined reduction ratio.

4. The impact-driven rotating device as recited in claim 1, wherein said impact detector includes a microphone for converting impact sound caused by said hammer into an electrical signal and an impact detecting circuit for detecting the impact when an output voltage of said microphone exceeds a predetermined threshold value.

5. The impact-driven rotating device as recited in claim 1, wherein said rotation angle detector includes:

a light-shield plate having a plurality of slits and attached to said output shaft, photo interrupters disposed at opposite sides of a portion where said slits are formed; and a wave-shaping circuit for wave-shaping signals output from said photo-interrupters in accordance with a rotation of said light-shield plate to generate pulse signals, the number of the pulse signals corresponding to the rotation angle of said output shaft.

6. The impact-driven rotating device as recited in claim 1, wherein said rotation angle detector includes:

a frequency generator for generating a signal of a frequency proportional to a rotation number of said rotation driver; and a wave-shaping circuit for wave-shaping the signal generated by said frequency generator to output pulse signals, the number of the pulse signals corresponding to the rotation angle of said output shaft.

7. The impact-driven rotating device as recited in claim 1, wherein said rotation driver includes a driver main body having a drive shaft and a reducer for transmitting a rotation of said drive shaft to said hammer at a predetermined reduction ratio, wherein said rotation angle detector includes a drive shaft rotation angle detector for detecting a rotation angle of said drive shaft to detect the rotation angle of said output shaft from the detected value detected by said drive shaft rotation angle detector, and wherein said between-impacts rotation angle calculator calculates a rotation angle of said driving shaft rotated between a detection of a previous impact and that of a subsequent impact by said impact detector, from the detected value detected by said driving shaft rotation angle detector, and calculates an rotation angle of said output shaft by subtracting a rotational angle difference between the rotation angle of said hammer generated every impacts of said output shaft and that of said output shaft from the value obtained by dividing the rotation angle detected by said driving shaft rotation angle detector by the reduction ratio of said reducer.

8. The impact-driven rotating device as recited in claim 1, further comprising an impact number counter, wherein said impact number counter counts the number of impacts caused by hitting the output shaft by said hammer after the rotation angle calculated by said between-impacts rotation angle calculator becomes smaller than a predetermined threshold value, and wherein said tightening torque calculator calculates a tightening torque by multiplying a square root of the number of impacts counted by said impact number counter by a proportional coefficient determined in accordance with a member to be tightened.

9. An impact-driven rotating device, comprising:

a motor having a driving shaft;

a reducer for reducing a rotation of said driving shaft at a predetermined reduction ratio;

a hammer to which a rotation force of said motor is transmitted via said reducer;

an output shaft having an anvil portion to be hit by said hammer to cause an impact rotation force;

a microphone for converting impact sound caused by said hammer into an electric signal;

an impact detector for detecting an impact of said anvil portion caused by said hammer when an output voltage of said microphone exceeds a predetermined threshold value;

a rotation angle detector for detecting a rotation angle of said output shaft;

a controlling circuit for calculating a tightening torque from an output of said impact detector and that of said rotation angle detector to generate a stop signal for stopping said motor when a tightening torque becomes equal to or greater than a predetermined value; and a motor controller for stopping the rotation of said driving shaft of said motor depending on a stop signal input from said controlling circuit.

10. The impact-driven rotating device as recited in claim 9, wherein said rotation angle detector includes:

a light-shield plate having a plurality of slits and attached to said output shaft;

photo-interrupters disposed at opposite sides of a portion where said slits are formed; and a wave-shaping circuit for wave-shaping signals output from said photo-interrupters in accordance with a rotation of said light-shield plate to generate pulse signals, the number of pulse signals corresponding to the rotation angle of said.

11. The impact-driven rotating device as recited in claim 10, wherein said controlling circuit includes a counter, a timer, a rotation speed calculator, a between-impacts rotation angle calculator, and a tightening torque calculator, wherein said counter counts the number of pulse signals input from said wave-shaping circuit, wherein said timer generates an interrupt signal at a certain intervals, wherein said rotation speed calculator calculates the rotation speed of said output shaft from a counter value of said counter counted between an input of a previous interrupt signal and that of a subsequent interrupt signal, wherein said between-impacts rotation angle calculator calculates an rotation angle of said output shaft from values of said counter counted between a detection of a previous impact and that of a subsequent impact, and wherein said tightening torque calculator calculates energy imparted to said output shaft from the rotation speed of said output shaft calculated by said rotation speed calculator when said output shaft is hit by said hammer, and calculates a tightening torque from the energy calculated by said tightening torque calculator and the rotation angle calculated by said between-impacts rotation angle calculator to generate a stop signal for stopping said motor when the tightening torque becomes equal to or greater than a predetermined torque.

12. The impact-driven rotating device as recited in claim 11, wherein said rotation angle detector includes a drive shaft angle detector for detecting an rotation angle of a drive shaft of said motor to detect the rotation angle of said output shaft from the detected value obtained by said drive shaft rotation angle detector, and wherein said between-impacts rotation angle calculator calculates the rotation angle of said driving shaft rotated between a detection of a previous impact and that of a subsequent impact, from the detected value obtained by said driving shaft rotation angle detector, and calculates a rotation angle of said output shaft by subtracting a rotational angle difference between the rotation angle of said hammer and that of said output shaft generated every impacts of said output shaft, from the value obtained by dividing the rotation angle calculated by between-impacts rotation angle calculator by the reduction ratio of said reducer.

13. The impact-driven rotating device as recited in claim 12, wherein said rotation angle detector includes a drive shaft angle detector for detecting an rotation angle of a drive shaft of said motor to detect the rotation angle of said output shaft from the detected value obtained by said drive shaft rotation angle detector, and wherein said between-impacts rotation angle calculator calculates the rotation angle of said driving shaft rotated between a detection of a previous impact and that of a subsequent impact, from the detected value obtained by said driving shaft rotation angle detector, and calculates a rotation angle of said output shaft by subtracting a rotational angle difference between the rotation angle of said hammer and that of said output shaft generated every impacts of said output shaft, from the value obtained by dividing the rotation angle calculated by between-impacts rotation angle calculator by the reduction ratio of said reducer.

14. The impact-driven rotating device as recited in claim 11, further comprising an impact number counter, wherein said impact number counter counts the number of impacts caused by hitting the output shaft by said hammer after the rotation angle calculated by said between-impacts rotation angle calculator becomes smaller than a predetermined threshold value, and wherein said tightening torque calculator calculates a tightening torque by multiplying a square root of the number of impacts counted by said impact number counter by a proportional coefficient determined in accordance with a member to be tightened.

15. The impact-driven rotating device as recited in claim 9, wherein said rotation angle detector includes:

a frequency generator for generating a signal of a frequency proportional to a rotation number of said rotation driver; and a wave-shaping circuit for wave-shaping the signal generated by said frequency generator to output pulse signals, the number of the pulse signals corresponding to the rotation angle of said output shaft.

16. The impact-driven rotating device as recited in claim 15, wherein said controlling circuit includes a counter, a timer, a rotation speed calculator, a between-impacts rotation angle calculator, and a tightening torque calculator, wherein said counter counts the number of pulse signals input from said wave-shaping circuit, wherein said timer generates an interrupt signal at a certain intervals, wherein said rotation speed calculator calculates the rotation speed of said output shaft from a counter value of said counter counted between an input of a previous interrupt signal and that of a subsequent interrupt signal, wherein said between-impacts rotation angle calculator calculates an rotation angle of said output shaft from values of said counter counted between a detection of a previous impact and that of a subsequent impact, and wherein said tightening torque calculator calculates energy imparted to said output shaft from the rotation speed of said output shaft calculated by said rotation speed calculator when said output shaft is hit by said hammer, and calculates a tightening torque from the energy calculated by said tightening torque calculator and the rotation angle calculated by said between-impacts rotation angle calculator to generate a stop signal for stopping said motor when the tightening torque becomes equal to or greater than a predetermined torque.

17. The impact-driven rotating device as recited in claim 16, further comprising an impact number counter, wherein said impact number counter counts the number of impacts caused by hitting the output shaft by said hammer after the rotation angle calculated by said between-impacts rotation angle calculator becomes smaller than a predetermined threshold value, and wherein said tightening torque calculator calculates a tightening torque by multiplying a square root of the number of impacts counted by said impact number counter by a proportional coefficient determined in accordance with a member to be tightened.

18. An impact-driven rotating device, comprising:

an output shaft;

a hammer for rotating said output shaft by imparting impact to said output shaft;

a rotation driver for rotating said hammer;

an impact detector for detecting the impact imparted by said hammer;

a rotation angle detector for detecting a rotation angle of said output shaft;

a between-impacts rotation angle calculator for calculating a rotation angle of said output shaft rotated between a detection of a previous impact and that of a subsequent impact by said impact detector, from the rotation angle detected by said rotation angle detector;

a tightening torque calculator for calculating a tightening torque by dividing the energy calculated by said energy calculator by the rotation angle calculated by said between-impacts rotation angle calculator; and a controller for stopping said rotation driver when the tightening torque calculated by said tightening torque calculator becomes equal to or greater than a predetermined value.

* * * * *